US009142891B2

(12) United States Patent
Liu et al.

(10) Patent No.: US 9,142,891 B2
(45) **Date of Patent: *Sep. 22, 2015**

(54) MAN-MADE COMPOSITE MATERIAL AND MAN-MADE COMPOSITE MATERIAL ANTENNA

(75) Inventors: Ruopeng Liu, Guangdong (CN); Chunlin Ji, Guangdong (CN); Yutao Yue, Guangdong (CN)

(73) Assignees: KUANG-CHI INNOVATIVE TECHNOLOGY LTD., FuTian District, Shenzhen, Guangdong (CN); KUANG-CHI INSTITUTE OF ADVANCED TECHNOLOGY, Nanshan District, Shenzhen, Guangdong (CN)

( * ) Notice: Subject to any disclaimer, the term of this patent is extended or adjusted under 35 U.S.C. 154(b) by 624 days.

This patent is subject to a terminal disclaimer.

(21) Appl. No.: 13/522,958

(22) PCT Filed: Nov. 16, 2011

(86) PCT No.: PCT/CN2011/082290

§ 371 (c)(1),
(2), (4) Date: Jul. 19, 2012

(87) PCT Pub. No.: WO2013/004063

PCT Pub. Date: Jan. 10, 2013

(65) Prior Publication Data

US 2013/0002499 A1 Jan. 3, 2013

(30) Foreign Application Priority Data

Jul. 1, 2011 (CN) ..... 2011 1 0183437
Jul. 1, 2011 (CN) ..... 2011 1 0183471
Jul. 1, 2011 (CN) ..... 2011 1 0183474

(51) Int. Cl.
*H01Q 19/06* (2006.01)
*H01Q 15/08* (2006.01)

(52) U.S. Cl.
CPC ..... *H01Q 15/08* (2013.01); *H01Q 19/06* (2013.01)

(58) Field of Classification Search
CPC ..... H01Q 15/02; H01Q 19/065
USPC ..... 343/753, 909, 757, 761, 782; 375/338; 250/339.05, 482.1, 503.1; 359/642, 359/620, 321, 341.32, 586, 652
See application file for complete search history.

(56) References Cited

U.S. PATENT DOCUMENTS 5,661,499 A * 8/1997 Epshtein et al. ..... 343/911 R
6,151,168 A * 11/2000 Goering et al. ..... 359/623
2011/0199281 A1* 8/2011 Morton et al. ..... 343/872

*Primary Examiner* — Sue A Purvis
*Assistant Examiner* — Jae Kim
(74) *Attorney, Agent, or Firm* — Winston Hsu; Scott Margo

(57) ABSTRACT

The present invention relates to a man-made composite material and a man-made composite material antenna. The man-made composite material is disposed in a propagation direction of a plane electromagnetic wave and convert it into a spherical wave. Reverse extensions of the spherical wave intersect at a virtual focus. A line connecting the virtual focus to a point on the second surface of the man-made composite material and a line perpendicular to the man-made composite material form an angle θ therebetween, which uniquely corresponds to a curved surface in the man-made composite material. A set formed by points having the same angle θ forms a boundary of the curved surface to which the angle θ uniquely corresponds. Each point on the curved surface to which the angle θ uniquely corresponds has a same refractive index. Refractive indices of the man-made composite material increase gradually as the angle θ increases.

20 Claims, 7 Drawing Sheets

MAN-MADE COMPOSITE MATERIAL AND MAN-MADE COMPOSITE MATERIAL ANTENNA

FIELD OF THE INVENTION

The present invention generally relates to the field of electromagnetic technologies, and more particularly, to a man-made composite material and a man-made composite material antenna.

BACKGROUND OF THE INVENTION

In conventional optics, a lens can be used to refract a plane wave into a spherical wave which appears to be radiated from a point light source located at a virtual focus of the lens. Currently, the diverging effect of the lens is achieved by virtue of the refractive property of the spherical form of the lens. The inventor has found in the process of making this invention that, the lens antenna has at least the following technical problems: the lens is bulky and heavy, which is unfavorable for miniaturization; performances of the lens rely heavily on the shape thereof, and directional propagation from the antenna can be achieved only when the lens has a precise shape; and serious interferences and losses are caused to the electromagnetic waves, which reduces the electromagnetic energy. Moreover, for most lens antennae, abrupt transitions of the refractive indices follow a simple line that is perpendicular to a lens surface. Consequently, electromagnetic waves propagating through the lenses suffer from considerable refraction, diffraction and reflection, which have a serious effect on the performances of the lenses.

SUMMARY OF THE INVENTION

In view of the aforesaid problems that the prior art antennae suffer from considerable refraction, diffraction and reflection and have poor lens performances, an objective of the present invention is to provide a man-made composite material and a man-made composite material antenna that have superior performances.

To achieve the aforesaid objective, the present invention provides a man-made composite material, which is disposed in a propagation direction of a plane electromagnetic wave. The plane electromagnetic wave is incident on a first surface of the man-made composite material and exits in the form of a spherical wave from a second surface of the man-made composite material opposite to the first surface. Reverse extensions of the exiting electromagnetic wave intersect with each other at a virtual focus of the man-made composite material. A line connecting the virtual focus to a point on the second surface of the man-made composite material and a line perpendicular to the man-made composite material form an angle θ therebetween, which uniquely corresponds to a curved surface in the man-made composite material. A set formed by points having the same angle θ forms a boundary of the curved surface to which the angle θ uniquely corresponds. Each point on the curved surface to which the angle θ uniquely corresponds has a same refractive index. Refractive indices of the man-made composite material increase gradually as the angle θ increases.

Preferably, a refractive index distribution of the curved surface satisfies:

$$n(\theta) = \frac{1}{S(\theta)}\left[\frac{(F+d)}{\cos\theta} - (F+d) + n_{min}d\right],$$

where, S(θ) is an arc length of a generatrix of the curved surface, F is a distance from the virtual focus to the man-made composite material; d is a thickness of the man-made composite material; and $n_{min}$ is a minimum refractive index of the man-made composite material.

Preferably, the generatrix of the curved surface is a parabolic arc or an elliptical arc.

Preferably, the arc length S(θ) of the parabolic arc satisfies:

$$S(\theta) = \frac{d}{2}\left[\frac{\log\left(|\tan\theta| + \sqrt{1+\tan^2\theta}\right) + \delta}{|\tan\theta| + \delta} + \sqrt{1+\tan^2\theta}\right],$$

where δ is a preset decimal.

Preferably, when a line passing through a center of the second surface of the man-made composite material and perpendicular to the man-made composite material is taken as an abscissa axis and a line passing through the center of the second surface of the man-made composite material and parallel to the second surface is taken as an ordinate axis, an equation of a parabola where the parabolic arc is located is represented as:

$$y(x) = \tan\theta\left(-\frac{1}{2d}x^2 + x + F + d\right).$$

Preferably, the angle θ and each point (x, y) of the parabolic arc satisfy the following relational expression:

$$\theta(x, y) = \tan^{-1}\left[\frac{2dy}{2d(F+d+x) - x^2}\right].$$

Preferably, when a line passing through a center of the second surface of the man-made composite material and perpendicular to the man-made composite material is taken as an abscissa axis and a line passing through the center of the second surface of the man-made composite material and parallel to the second surface is taken as an ordinate axis, an equation of an ellipse where the elliptical arc is located is represented as:

$$\frac{(x-d)^2}{a^2} + \frac{(y-c)^2}{b^2} = 1;$$

where a, b and c satisfy the following relationships:

$$\frac{d^2}{a^2} + \frac{[(F+d)\tan\theta - c]^2}{b^2} = 1;$$

$$\frac{\sin\theta}{\sqrt{n^2(\theta) - \sin^2(\theta)}} = \frac{b^2}{a^2}\frac{d}{(F+d)\tan\theta - c}.$$

Preferably, a center of the ellipse where the elliptical arc is located is located on the first surface and has coordinates (d, c).

Preferably, a point on the second surface corresponding to the angle θ has a refraction angle θ', and a refractive index n(θ) of the point satisfies:

$$n(\theta) = \frac{\sin\theta}{\sin\theta'}.$$

Preferably, the man-made composite material comprises at least one man-made composite material sheet layer, each of which comprises a sheet-like substrate and a plurality of man-made microstructures attached on the substrate.

To achieve the aforesaid objective, the present invention further provides a man-made composite material antenna, which comprises a radiation source and a man-made composite material disposed in a propagation direction of a plane electromagnetic wave. The plane electromagnetic wave is incident on a first surface of the man-made composite material and exits in the form of a spherical wave from a second surface of the man-made composite material opposite to the first surface. Reverse extensions of the exiting electromagnetic wave intersect with each other at a virtual focus of the man-made composite material. A line connecting the virtual focus to a point on the second surface of the man-made composite material and a line perpendicular to the man-made composite material form an angle θ therebetween, which uniquely corresponds to a curved surface in the man-made composite material. A set formed by points having the same angle θ forms a boundary of the curved surface to which the angle θ uniquely corresponds. Each point on the curved surface to which the angle θ uniquely corresponds has a same refractive index. Refractive indices of the man-made composite material increase gradually as the angle θ increases.

Preferably, a refractive index distribution of the curved surface satisfies:

$$n(\theta) = \frac{1}{S(\theta)}\left[\frac{(F+d)}{\cos\theta} - (F+d) + n_{min}d\right],$$

where, S(θ) is an arc length of a generatrix of the curved surface, F is a distance from the virtual focus to the man-made composite material; d is a thickness of the man-made composite material; and $n_{min}$ is a minimum refractive index of the man-made composite material.

Preferably, the generatrix of the curved surface is a parabolic arc or an elliptical arc.

Preferably, the arc length S(θ) of the parabolic arc satisfies:

$$S(\theta) = \frac{d}{2}\left[\frac{\log\left(|\tan\theta| + \sqrt{1+\tan^2\theta}\right) + \delta}{|\tan\theta| + \delta} + \sqrt{1+\tan^2\theta}\right],$$

where δ is a preset decimal.

Preferably, when a line passing through a center of the second surface of the man-made composite material and perpendicular to the man-made composite material is taken as an abscissa axis and a line passing through the center of the second surface of the man-made composite material and parallel to the second surface is taken as an ordinate axis, an equation of a parabola where the parabolic arc is located is represented as:

$$y(x) = \tan\theta\left(-\frac{1}{2d}x^2 + x + F + d\right).$$

Preferably, the angle θ and each point (x, y) of the parabolic arc satisfy the following relational expression:

$$\theta(x, y) = \tan^{-1}\left[\frac{2dy}{2d(F+d+x) - x^2}\right].$$

Preferably, when a line passing through a center of the second surface of the man-made composite material and perpendicular to the man-made composite material is taken as an abscissa axis and a line passing through the center of the second surface of the man-made composite material and parallel to the second surface is taken as an ordinate axis, an equation of an ellipse where the elliptical arc is located is represented as:

$$\frac{(x-d)^2}{a^2} + \frac{(y-c)^2}{b^2} = 1;$$

where a, b and c satisfy the following relationships:

$$\frac{d^2}{a^2} + \frac{[(F+d)\tan\theta - c]^2}{b^2} = 1;$$

$$\frac{\sin\theta}{\sqrt{n^2(\theta) - \sin^2(\theta)}} = \frac{b^2}{a^2}\frac{d}{(F+d)\tan\theta - c}.$$

Preferably, a center of the ellipse where the elliptical arc is located is located on the first surface and has coordinates (d, c).

Preferably, a point on the second surface corresponding to the angle θ has a refraction angle 'θ', and a refractive index n(θ) of the point satisfies:

$$n(\theta) = \frac{\sin\theta}{\sin\theta'}.$$

Preferably, the man-made composite material comprises at least one man-made composite material sheet layer, each of which comprises a sheet-like substrate and a plurality of man-made microstructures attached on the substrate.

The technical solutions of the present invention have the following benefits: by designing abrupt transitions of the refractive indices of the man-made composite material to follow a curved surface, the refraction, diffraction and reflection at the abrupt transition points can be significantly reduced. As a result, the problems caused by interferences are eased, which further improves performances of the man-made composite material and the man-made composite material antenna.

BRIEF DESCRIPTION OF THE DRAWINGS

To describe the technical solutions of embodiments of the present invention more clearly, the attached drawings necessary for description of the embodiments will be introduced briefly hereinbelow. Obviously, these attached drawings only illustrate some of the embodiments of the present invention, and those of ordinary skill in the art can further obtain other attached drawings according to these attached drawings without making inventive efforts. In the attached drawings.

DETAILED DESCRIPTION OF THE INVENTION

Figure 1:
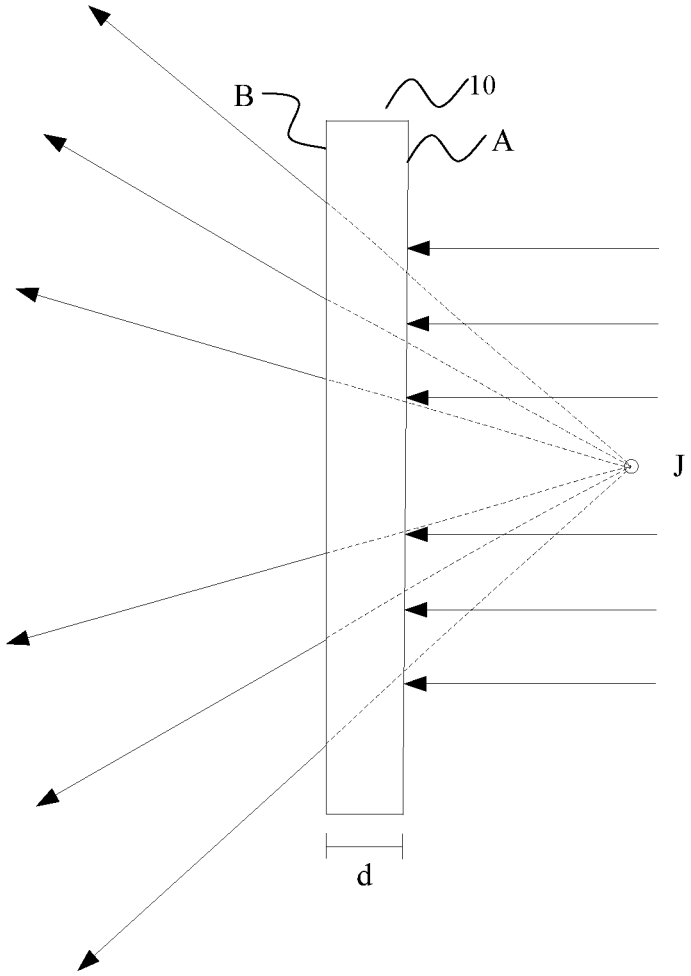
FIG. 1 is a schematic view illustrating a diverging effect of a man-made composite material according to an embodiment of the present invention on an electromagnetic wave.

FIG. 1 is a schematic view illustrating a diverging effect or a man-made composite material 10 according to an embodiment of the present invention on an electromagnetic wave. The man-made composite material 10 is disposed in a propagation direction of an electromagnetic wave emitted from a radiation source. The plane electromagnetic wave is incident on a first surface A of the man-made composite material and exits in the form of a spherical wave from a second surface B of the man-made composite material opposite to the first surface A. Reverse extensions of the exiting electromagnetic wave intersect with each other at a virtual focus J of the man-made composite material.

As can be known as a common sense, the refractive index of the electromagnetic wave is proportional to $\sqrt{\epsilon \times \mu}$. When an electromagnetic wave propagates from a medium to another medium, the electromagnetic wave will be refracted; and if the refractive index distribution in the material is non-uniform, then the electromagnetic wave will be deflected towards a site having a larger refractive index. By designing electromagnetic parameters of the man-made composite material at each point, the refractive index distribution of the man-made composite material can be adjusted so as to achieve the purpose of changing the propagating path of the electromagnetic wave.

Figure 2:
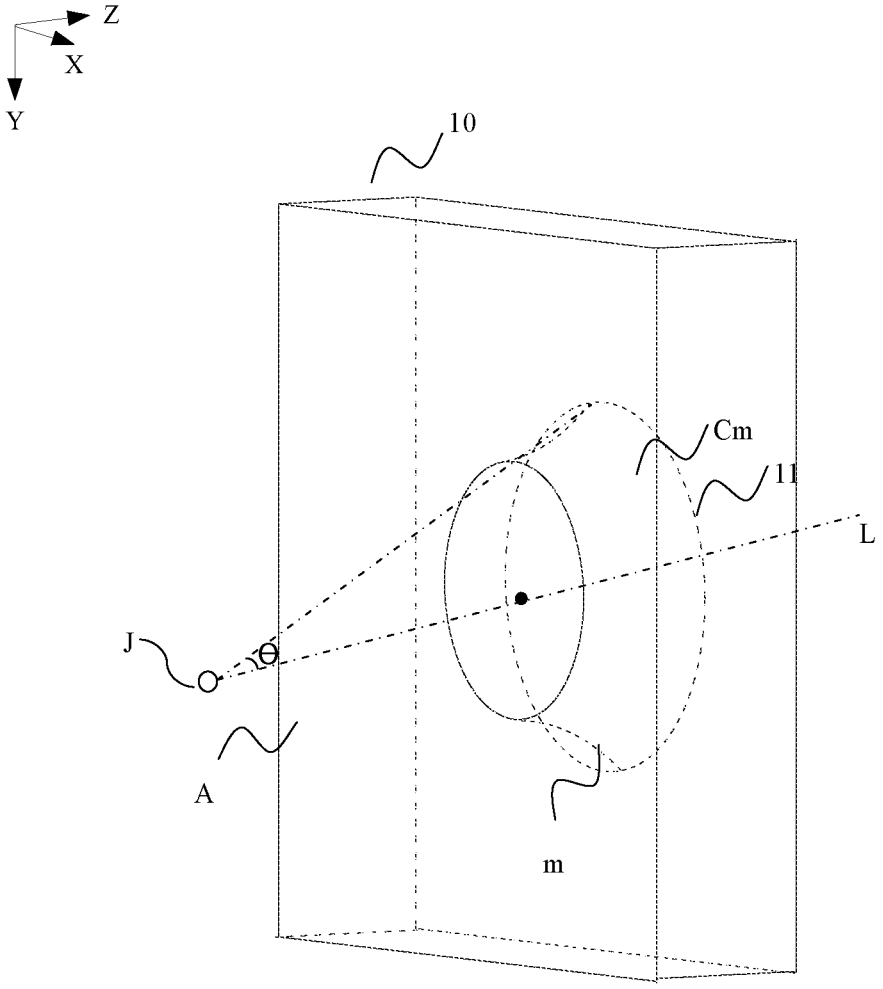
FIG. 2 is a schematic view illustrating a form of a curved surface in the man-made composite material 10 shown in FIG. 1 to which an angle θ uniquely corresponds.

FIG. 2 is a schematic view illustrating a form of a curved surface in the man-made composite material 10 shown in FIG. 1 to which an angle θ uniquely corresponds. As shown, a line connecting the virtual focus J to a point on the second surface B (the surface opposite to the surface A) of the man-made composite material 10 and a line passing through a center O of the first surface A of the man-made composite material 10 and perpendicular to the man-made composite material 10 form an angle θ therebetween, which uniquely corresponds to a curved surface Cm in the man-made composite material 10. A set formed by points having the same angle θ forms a boundary (shown as a circle 11) of the curved surface Cm to which the angle θ uniquely corresponds. Each point on the curved surface Cm to which the angle θ uniquely corresponds has a same refractive index. A generatrix of the curved surface is an arc m. Refractive indices of the man-made composite material 10 increase gradually as the angle θ increases.

Figure 3:
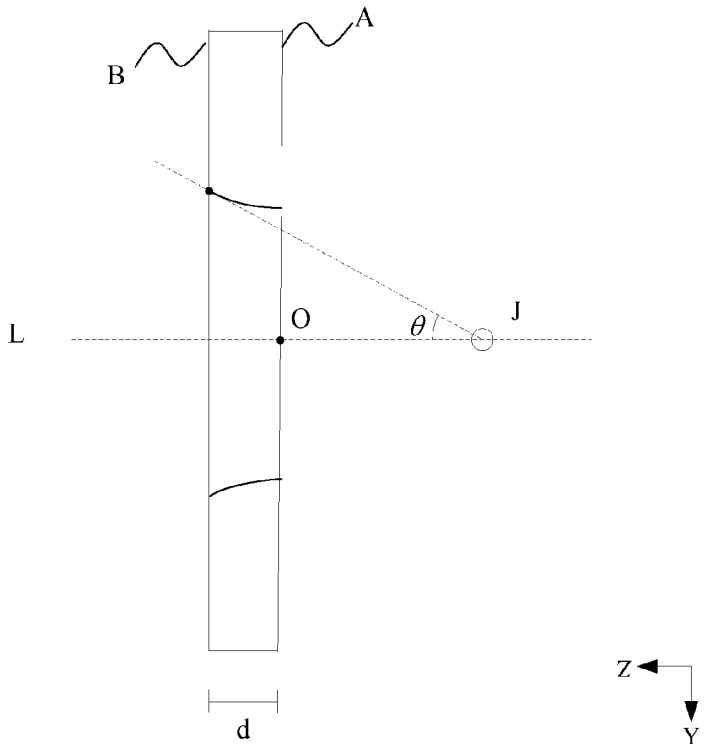
FIG. 3 is a side view of the man-made composite material 10 shown in FIG. 2.
Figure 4:
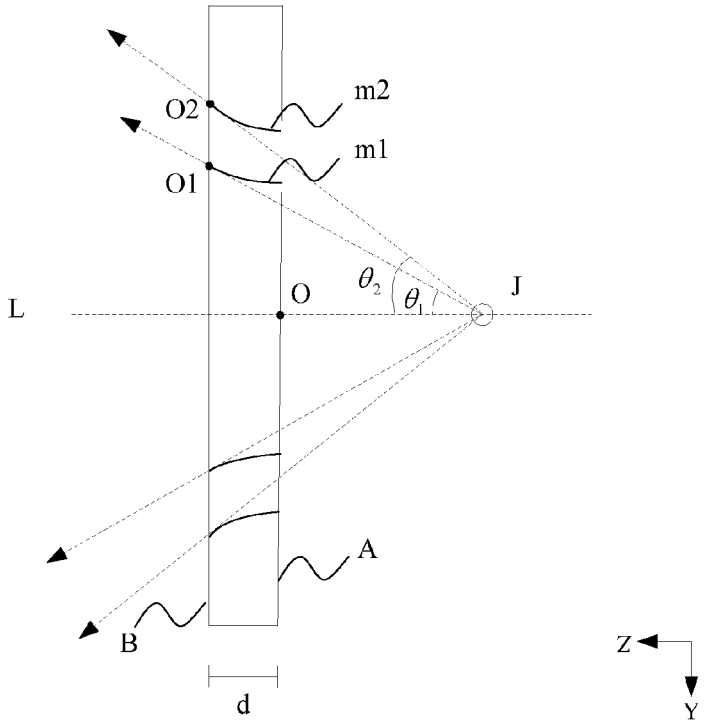
FIG. 4 is a schematic view illustrating an arc shown in FIG. 3.

As shown in FIG. 2, the generatrix ° tittle curved surface Cm is the arc m, and the curved surface Cm is obtained through rotation of the arc m about a line L. FIG. 3 is a side view of the man-made composite material 10. The thickness of the man-made composite material 10 is as shown by d, and L represents a line perpendicular to the man-made composite material. A side cross-sectional view of a curved surface having a same refractive index is in the form of two arcs, which are symmetrical with respect to the line L. Each of the arcs shown by a solid line is a generatrix of a virtual curved surface in the man-made composite material 10. In order to more clearly describe that refractive indices on a same curved surface are identical to each other, the virtual curved surface (which does not exist actually, and is elucidated only for convenience of description) in the man-made composite material will be also elucidated. As shown in FIG. 4, a line connecting the radiation source to a point O1 on the second surface B of the man-made composite material and the line L passing through the center O of the first surface and perpendicular to the man-made composite material 10 form an angle $\theta_1$ therebetween, which corresponds to an arc m1; and each point on a virtual curved surface which is obtained through rotation of the arc m1 has a same refractive index. Likewise, a line connecting the radiation source to a point O2 on the second surface of the man-made composite material and the line L form an angle $\theta_2$ therebetween, which corresponds to an arc m2; and each point on a virtual curved surface which is obtained through rotation of the arc m2 has a same refractive index.

A refractive index distribution of the virtual curved surface satisfies:

$$n(\theta) = \frac{1}{S(\theta)}\left[\frac{(F+d)}{\cos\theta} - (F+d) + n_{min}d\right].$$

Figure 5:
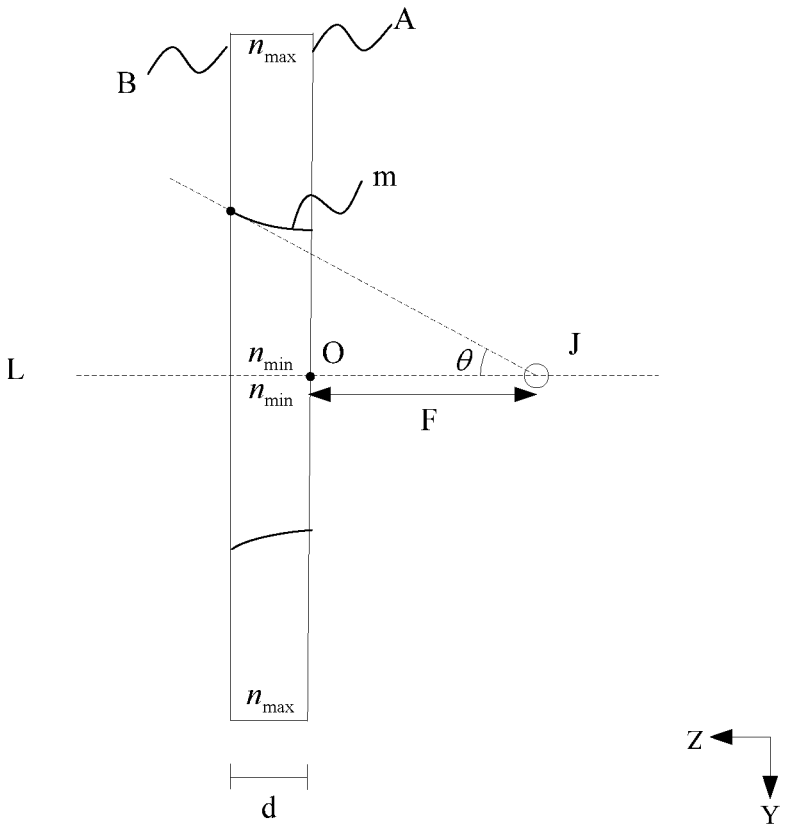
FIG. 5 is a schematic view illustrating variations of refractive indices.

As shown in FIG. 5, S(θ) is an arc length of the generatrix (the arc m) of the virtual curved surface. F is a distance from the virtual focus J to the man-made composite material 10, d is a thickness of the man-made composite material 10, $n_{min}$ is a minimum refractive index of the man-made composite material, and $n_{max}$ is a maximum refractive index of the man-made composite material.

Hereinbelow, a case in which the are m is a parabolic arc and a case in which the arc m is an elliptical arc will be respectively illustrated as an example.

Supposing that the arc m is a parabolic arc, then the arc length S(θ) of the parabolic arc m satisfies the following equation:

$$S(\theta) = \frac{d}{2}\left[\frac{\log\left(|\tan\theta| + \sqrt{1+\tan^2\theta}\right) + \delta}{|\tan\theta| + \delta} + \sqrt{1+\tan^2\theta}\right],$$

where δ is a preset decimal (e.g., 0.0001), and can ensure that the ratio $$\frac{\log\left(|\tan\theta| + \sqrt{1+\tan^2\theta}\right) + \delta}{|\tan\theta| + \delta}$$

converges when the angle θ approaches to 0. The angle θ ranges between $$\left[0, \frac{\pi}{2}\right).$$

Figure 6:
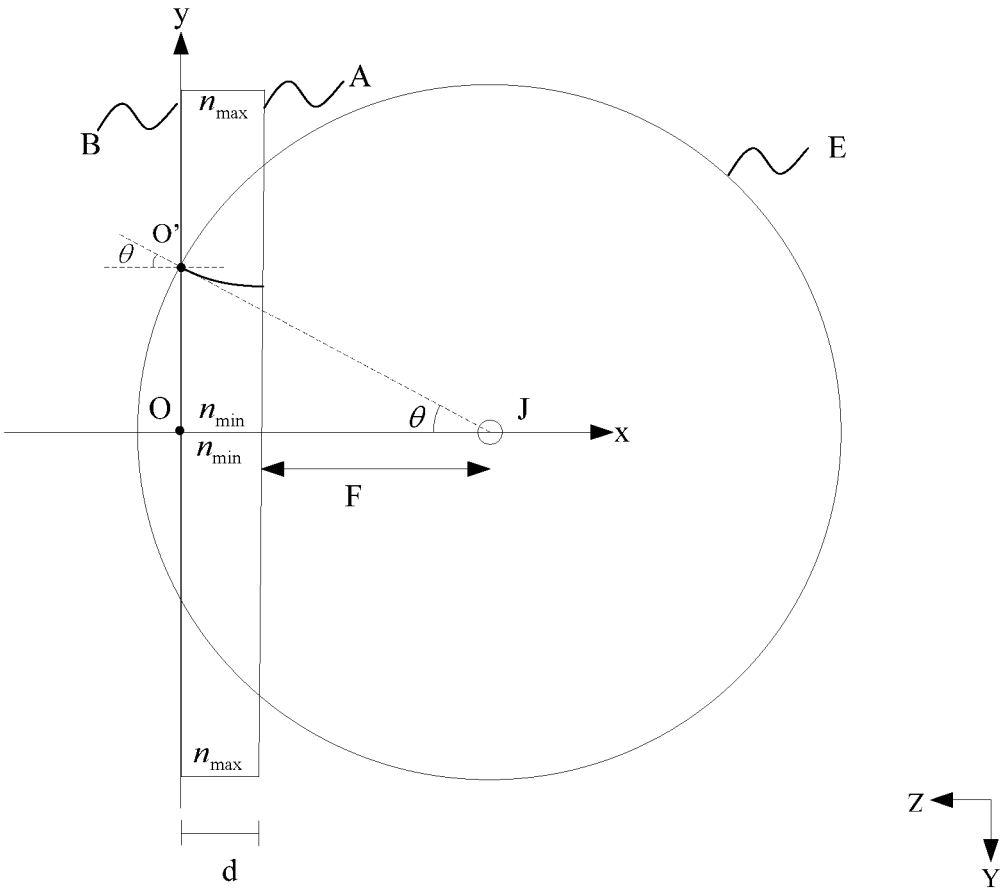
FIG. 6 is a schematic view illustrating coordinates of the arc shown in FIG. 3 when being a parabolic arc.

As shown in FIG. 6, when the line L passing through the center O of the second surface of the man-made composite material 10 and perpendicular to the man-made composite material 10 is taken as an abscissa axis and a line passing through the center O of the second surface of the man-made composite material 10 and parallel to the second surface is taken as an ordinate axis, a line connecting the virtual focus J to a certain point O' on the surface B and the X axis form an angle θ therebetween. The angle θ and each point (x, y) of the parabolic arc satisfy the following relational expression:

$$\theta(x, y) = \tan^{-1}\left[\frac{2dy}{2d(F+d+x)-x^2}\right].$$

Suppose that an equation of a parabola where the parabolic arc m shown by a solid line is located is: $y(x)=ax^2+bx+c$. The parabola passes through a point (0, (F+d) tan θ): y(0)=c=(F+d)tan θ. In order to make the electromagnetic wave propagate in a direction of the designed parabola, a tangent line of the parabolic arc must be parallel with the X axis when the electromagnetic wave propagates through the first surface A of the man-made composite material; i.e., it must be ensured that y'(d)=0. Because y'(x)=2ax+b, y'(d)=2ad+b=0. In addition, it must also be ensured that the electromagnetic wave propagates in a tangent direction corresponding to the angle θ when reaching the second surface B of the man-made composite material, so y' (0)=tan θ. An exit direction of the electromagnetic wave at any point O' on the surface B is a direction of a radius JO' in a sphere E with the virtual focus J as a circle center, i.e., a direction perpendicular to a surface of the sphere E. It can be derived from the aforesaid conditions that the equation of the parabola is $$y(x) = \tan\theta\left(-\frac{1}{2d}x^2 + x + F + d\right).$$

Thereby, a relational expression between the angle θ and each point (x, y) on the parabolic arc m can be obtained as $$\theta(x, y) = \tan^{-1}\left[\frac{2dy}{2d(F+d+x)-x^2}\right].$$

The angle θ uniquely corresponds to a curved surface in the man-made composite material, which is obtained through rotation of the generatrix m about the line L (the X axis); and each point on the curved surface to which the angle θ uniquely corresponds has a same refractive index.

Figure 7:
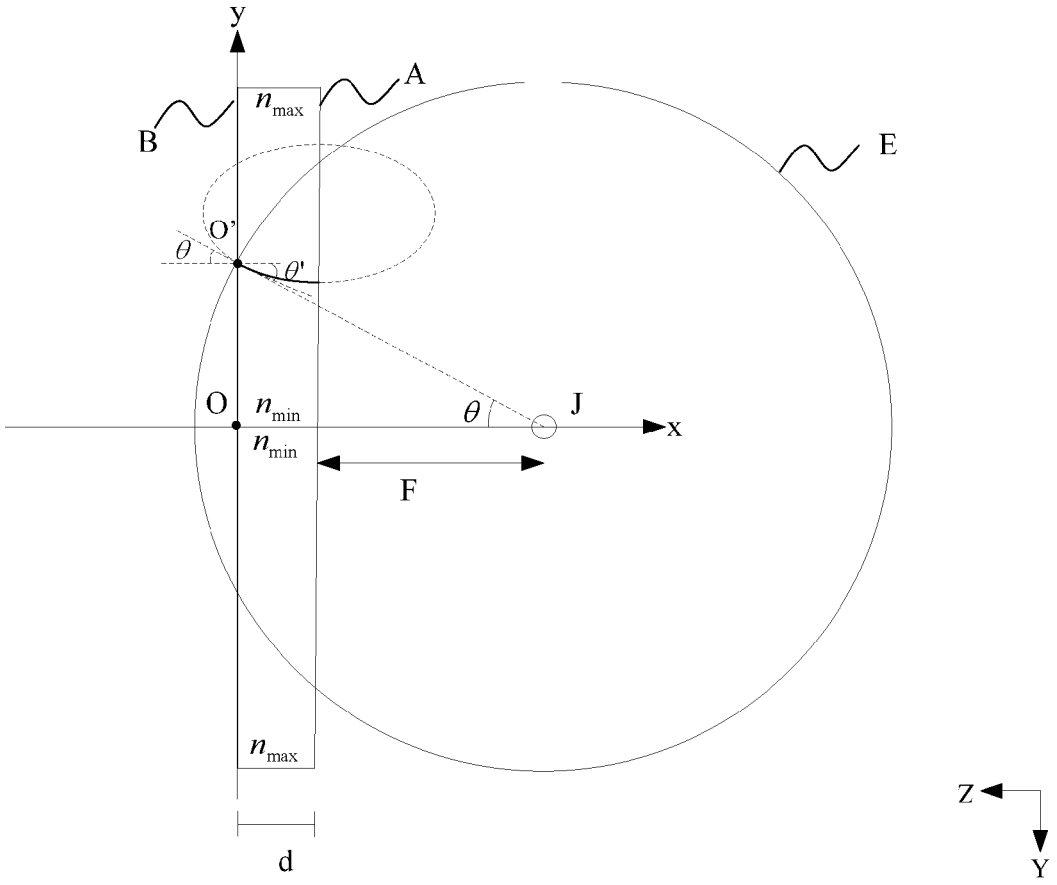
FIG. 7 is a schematic view illustrating coordinates of the arc shown in FIG. 3 when being an elliptical arc.

Suppose that the arc m is an elliptical arc. As shown in FIG. 7, when the line L passing through the center O of the second surface of the man-made composite material 10 and perpendicular to the man-made composite material 10 is taken as an abscissa axis and the line passing through the center O of the second surface of the man-made composite material 10 and parallel to the second surface is taken as an ordinate axis, a line connecting the virtual focus J to any point O' on the surface B and the X axis form an angle θ therebetween. An equation of an ellipse where the elliptical arc m shown by a solid line on the ellipse is located is:

$$\frac{(x-d)^2}{a^2} + \frac{(y-c)^2}{b^2} = 1.$$

A center of the ellipse is located on the first surface A, and has coordinates (d, c). The ellipse passes through a point (0, (F+d) tan θ); i.e., y(0)=(F+d)tan θ. Through the equation of the ellipse, it can be obtained that $$\frac{d^2}{a^2} + \frac{[(F+d)\tan\theta - c]^2}{b^2} = 1.$$

When a plane wave is incident on the man-made composite material, a tangent line of the electromagnetic wave on the elliptical arc of the first surface A of the man-made composite material must be parallel with the X axis; i.e., it must be ensured that y'(d)=0. A tangential equation at any point (x, y) on the ellipse is $$\frac{dy}{dx} = -\frac{b^2}{a^2}\frac{x-d}{y-c},$$

so it can be obtained that y'(d)=0. An exit direction of the electromagnetic wave at any point O' on the surface B is a direction of a radius JO' in a sphere E with the virtual focus J as a circle center. i.e., a direction perpendicular to a surface of the sphere E.

The point O' on the second surface B corresponding to the angle θ has a refraction angle θ' and a refractive index n(θ); and it can be known from the Snell's law that $$n(\theta) = \frac{\sin\theta}{\sin\theta'}.$$

The electromagnetic wave propagates in a tangent direction corresponding to the refraction angle θ' when reaching the second surface B of the man-made composite material 10 from the external (as shown in FIG. 6). That is, at a point where the elliptical arc m infinitely approaches to the point O', $y'(0^+)=\tan\theta'$. Thereby, the following relational expressions can be obtained:

$$y'(0^+) = \tan\theta' = \frac{\sin\theta}{\sqrt{n^2(\theta)-\sin^2(\theta)}} = \frac{b^2}{a^2}\frac{d}{(F+d)\tan\theta - c};$$

$$\frac{\sin\theta}{\sqrt{n^2(\theta)-\sin^2(\theta)}} = \frac{b^2}{a^2}\frac{d}{(F+d)\tan\theta - c}.$$

The angle θ uniquely corresponds to a curved surface in the man-made composite material, which is obtained through rotation of the generatrix m about the line L (the X axis); and each point on the curved surface to which the angle θ uniquely corresponds has a same refractive index.

It shall be appreciated that, when a=b in the ellipse, the ellipse becomes a true circle; and in this case, the corresponding elliptical arc becomes a circular arc, and the curved surface is formed through rotation of the circular arc about the line L (the X axis).

Figure 8:
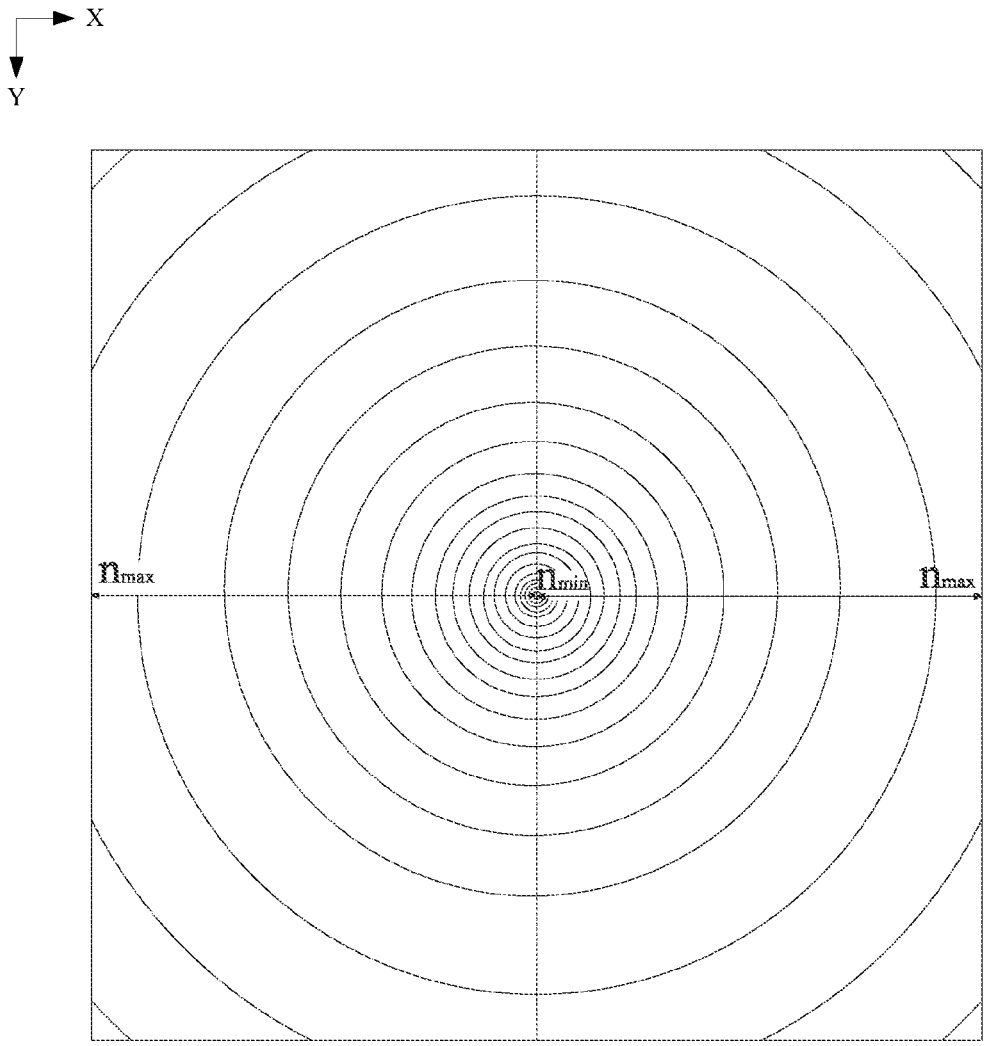
FIG. 8 is a diagram illustrating the refractive index distribution in a yx plane.

The man-made composite material can be used to convert a plane wave emitted from the radiation source into a spherical wave. Refractive indices of the man-made composite material increase from $n_{min}$ to $n_{max}$ as the angle θ increases, as shown in FIG. 8. A segment of the parabolic arc shown by a solid line on the parabola is a generatrix of a virtual curved surface, and refractive indices on a same curved surface are identical to each other. It shall be appreciated that, the man-made composite material of the present invention may also be used to convert a spherical wave into a plane wave (i.e., a case reversed from what is shown in FIG. 1) without the need of changing the construction of the man-made composite material. Therefore, various applications adopting the principle of the present invention shall all fall within the scope of the present invention.

In practical structure designs, the man-made composite material may be designed to be formed by a plurality of man-made composite material sheet layers, each of which comprises a sheet-like substrate and a plurality of man-made microstructures or man-made pore structures attached on the substrate. The overall refractive index distribution of the plurality of man-made composite material sheet layers combined together must satisfy or approximately satisfy the aforesaid equations so that refractive indices on a same curved surface are identical to each other, and the generatrix of the curved surface is designed as a parabolic arc. Of course, in practical designs, it may be relatively difficult to design the generatrix of the curved surface as an accurate parabolic arc or an accurate elliptical arc, so the generatrix of the curved surface may be designed as an approximate parabolic arc, an approximate elliptical arc or a stepped form as needed and degrees of accuracy may be chosen as needed. With continuous advancement of the technologies, the designing manners are also updated continuously, and there may be a better designing process for the man-made composite material to achieve the refractive index distribution provided by the present invention.

Each of the man-made microstructures is a two-dimensional (2D) or three-dimensional (3D) structure comprising a metal wire and having a geometric pattern, and may be of, for example but is not limited to, a cross shape, a 2D snowflake shape or a 3D snowflake shape. The metal wire may be a copper wire or a silver wire, and may be attached on the substrate through etching, electroplating, drilling, photolithography, electron etching or ion etching. The plurality of man-made microstructures in the man-made composite material make the refractive indices of the man-made composite material increase with the angle θ increases. Given that an incident electromagnetic wave is known, by appropriately designing topology patterns of the man-made microstructures and designing arrangement of the man-made microstructures of different dimensions within an electromagnetic wave converging component, the refractive index distribution of the man-made composite material can be adjusted to convert the plane electromagnetic wave into an electromagnetic wave diverging in the form of a spherical wave.

In order to more intuitively represent the refractive index distribution of each of the man-made composite material sheet layers in a YX plane, the units that have the same refractive index are connected to form a line, and the magnitude of the refractive index is represented by the density of the lines. A higher density of the lines represents a larger refractive index. The refractive index distribution of the man-made composite material satisfying all of the above relational expressions is as shown in FIG. 8.

The present invention has been elucidated in detail by taking the parabolic arc and the elliptical arc as examples. As a non-limiting example, the present invention may further apply to other kinds of curves such as irregular curves. The cases satisfying the refractive index distribution principle of the present invention shall all fall within the scope of the present invention.

The present invention further provides a man-made composite material antenna. A part from the man-made composite material 10 as shown in FIG. 1 and FIG. 2, the man-made composite material antenna further comprises a radiation source disposed at a side of the man-made composite material 10. The structure and the refractive index variations of the man-made composite material 10 have been described above, and thus will not be further described herein.

The aforesaid man-made composite material may be in the form shown in FIG. 2, and of course, may also be made into other desired forms such as an annular form so long as the aforesaid refractive index variation rules can be satisfied.

In practical applications, in order to achieve better performances of the man-made composite material and reduce the reflection, an impedance matching layer may be disposed at each of two sides of the man-made composite material. Details of the impedance matching layer can be found in the prior art documents, and thus will not be further described herein.

By designing abrupt transitions of the refractive indices of the man-made composite material to follow a curved surface according to the present invention, the refraction, diffraction and reflection at the abrupt transition points can be significantly reduced. As a result, the problems caused by interferences are eased, which further improves performances of the man-made composite material.

The embodiments of the present invention have been described above with reference to the attached drawings; however, the present invention is not limited to the aforesaid embodiments, and these embodiments are only illustrative but are not intended to limit the present invention. Those of ordinary skill in the art may further devise many other implementations according to the teachings of the present invention without departing from the spirits and the scope claimed in the claims of the present invention, and all of the implementations shall fall within the scope of the present invention.

What is claimed is:

1. A man-made composite material having a thickness between a first and second surface, configured such that the first and second surfaces are perpendicularly disposed to a propagation direction of a plane electromagnetic wave, a curved surface within the man-made material that extends through the thickness, wherein the plane electromagnetic wave is incident on the first surface of the man-made composite material, a spherical electromagnetic wave exits from the second surface of the man-made composite material, and reverse extensions of the exiting spherical electromagnetic wave intersect with each other at a virtual focus of the man-made composite material;

a set of first straight lines connecting the virtual focus to a corresponding set of points on a circular boundary line between the curved surface and the second surface of the man-made composite material, and a second straight line perpendicular to the man-made composite material, wherein each first straight line forms an angle θ with the second straight line, wherein the same angle θ corresponds to each of the points in the set;

additional sets of first straight lines connecting the virtual focus to additional corresponding sets of points along the curved surface, wherein each additional set of points on the curved surface form a circular line and has a same uniquely corresponding angle θ and a same refractive index;

the curved surface has a generatrix which extends along a direction of the thickness of the man-made composite material and between the first surface and the second surface is formed by rotating the generatrix about the second straight line; and refractive indices of the man-made composite material increase gradually as the angle θ increases.

2. The man-made composite material of claim 1, wherein a refractive index distribution of the curved surface satisfies:

$$n(\theta) = \frac{1}{S(\theta)}\left[\frac{(F+d)}{\cos\theta} - (F+d) + n_{min}d\right],$$

where, S(θ) is an arc length of a generatrix of the curved surface, F is a distance from the virtual focus to the man-made composite material; d is a thickness of the man-made composite material; and $n_{min}$ is a minimum refractive index of the man-made composite material.

3. The man-made composite material of claim 2, wherein the generatrix of the curved surface is a parabolic arc or an elliptical arc.

4. The man-made composite material of claim 3, wherein the arc length S(θ) of the parabolic arc satisfies:

$$S(\theta) = \frac{d}{2}\left[\frac{\log\left(|\tan\theta| + \sqrt{1+\tan^2\theta}\right) + \delta}{|\tan\theta| + \delta} + \sqrt{1+\tan^2\theta}\right],$$

where δ is a preset decimal.

5. The man-made composite material of claim 4, wherein when a line passing through a center of the second surface of the man-made composite material and perpendicular to the man-made composite material is taken as an abscissa axis and a line passing through the center of the second surface of the man-made composite material and parallel to the second surface is taken as an ordinate axis an equation of a parabola where the parabolic arc is located is represented as:

$$y(x) = \tan\theta\left(-\frac{1}{2d}x^2 + x + F + d\right).$$

6. The man-made composite material of claim 5, wherein the angle θ and each point (x, y) of the parabolic arc satisfy the following relational expression:

$$\theta(x, y) = \tan^1\left[\frac{2dy}{2d(F+d+x) - x^2}\right].$$

7. The man-made composite material of claim 3, wherein when a line passing through a center of the second surface of the man-made composite material and perpendicular to the man-made composite material is taken as an abscissa axis and a line passing through the center of the second surface of the man-made composite material and parallel to the second surface is taken as an ordinate axis, an equation of an ellipse where the elliptical arc is located is represented as:

$$\frac{(x-d)^2}{a^2} + \frac{(y-c)^2}{b^2} = 1;$$

where a, b and c satisfy the following relationships:

$$\frac{d^2}{a^2} + \frac{[(F+d)\tan\theta - c]^2}{b^2} = 1;$$

$$\frac{\sin\theta}{\sqrt{n^2(\theta) - \sin^2(\theta)}} = \frac{b^2}{a^2}\frac{d}{(F+d)\tan\theta - c}.$$

8. The man-made composite material of claim 7, wherein a center of the ellipse where the elliptical arc is located is located on the first surface and has coordinates (d, c).

9. The man-made composite material of claim 7, wherein a point on the second surface corresponding to the angle θ has a refraction angle θ', and a refractive index n(θ) of the point satisfies:

$$n(\theta) = \frac{\sin\theta}{\sin\theta'}.$$

10. The man-made composite material of claim 2, wherein the man-made composite material comprises at least one man-made composite material sheet layer, each of which comprises a sheet-like substrate and a plurality of man-made microstructures attached on the substrate, and each of the man-made microstructures is a two-dimensional (2D) or three-dimensional (3D) structure comprising at least one metal wire and having a geometric pattern, and is of an I shape, a cross shape, or an elliptical shape.

11. A man-made composite material antenna having a thickness between a first and second surface, comprising a radiation source and a man-made composite material configured such that the first and second surfaces are perpendicularly disposed to a propagation direction of a plane electromagnetic wave, a curved surface within the man-made material that extends through the thickness, wherein the plane electromagnetic wave is incident on the first surface of the man-made composite material, a spherical electromagnetic wave exits from the second surface of the man-made composite material, and reverse extensions of the exiting spherical electromagnetic wave intersect with each other at a virtual focus of the man-made composite material;

a set of first straight lines connecting the virtual focus to a corresponding set of points on a circular boundary line between the curved surface and the second surface of the man-made composite material, and a second straight line perpendicular to the man-made composite material, wherein each first straight line forms an angle θ with the second straight line, wherein the same angle θ corresponds to each of the points in the set;

additional sets of first straight lines connecting the virtual focus to additional corresponding sets of points along the curved surface, wherein each additional set of points on the curved surface form a circular line and has a same uniquely corresponding angle θ and a same refractive index;

the curved surface has a generatrix which extends along a direction of the thickness of the man-made composite material and between the first surface and the second surface is formed by rotating the generatrix about the second straight line; and refractive indices of the man-made composite material increase gradually as the angle θ increases.

12. The man-made composite material antenna of claim 11, wherein a refractive index distribution of the curved surface satisfies:

$$n(\theta) = \frac{1}{S(\theta)}\left[\frac{(F+d)}{\cos\theta} - (F+d) + n_{min}d\right],$$

where, S(θ) is an arc length of a generatrix of the curved surface, F is a distance from the virtual focus to the man-made composite material; d is a thickness of the man-made composite material; and $n_{min}$ is a minimum refractive index of the man-made composite material.

13. The man-made composite material antenna of claim 12, wherein the generatrix of the curved surface is a parabolic arc or an elliptical arc.

14. The man-made composite material antenna of claim 13, wherein the arc length S(θ) of the parabolic arc satisfies:

$$S(\theta) = \frac{d}{2}\left[\frac{\log\left(|\tan\theta| + \sqrt{1+\tan^2\theta}\right) + \delta}{|\tan\theta| + \delta} + \sqrt{1+\tan^2\theta}\right],$$

where δ is a preset decimal.

15. The man-made composite material antenna of claim 14, wherein when a line passing through a center of the second surface of the man-made composite material and perpendicular to the man-made composite material is taken as an to abscissa axis and a line passing through the center of the second surface of the man-made composite material and parallel to the second surface is taken as an ordinate axis, an equation of a parabola where the parabolic arc is located is represented as:

$$y(x) = \tan\theta\left(-\frac{1}{2d}x^2 + x + F + d\right).$$

16. The man-made composite material antenna of claim 15, wherein the angle θ and each point (x, y) of the parabolic arc satisfy the following relational expression:

$$\theta(x, y) = \tan^1\left[\frac{2dy}{2d(F+d+x) - x^2}\right].$$

17. The man-made composite material antenna of claim 13, wherein when a line passing through a center of the second surface of the man-made composite material and perpendicular to the man-made composite material is taken as an abscissa axis and a line passing through the center of the second surface of the man-made composite material and parallel to the second surface is taken as an ordinate axis, an equation of an ellipse where the elliptical arc is located is represented as:

$$\frac{(x-d)^2}{a^2} + \frac{(y-c)^2}{b^2} = 1;$$

where a, b and c satisfy the following relationships:

$$\frac{d^2}{a^2} + \frac{[(F+d)\tan\theta - c]^2}{b^2} = 1;$$

$$\frac{\sin\theta}{\sqrt{n^2(\theta) - \sin^2(\theta)}} = \frac{b^2}{a^2}\frac{d}{(F+d)\tan\theta - c}.$$

18. The man-made composite material antenna of claim 17, wherein a center of the ellipse where the elliptical arc is located is located on the first surface and has coordinates (d, c).

19. The man-made composite material antenna of claim 17, wherein a point on the second surface corresponding to the angle θ has a refraction angle θ', and a refractive index n(θ) of the point satisfies:

$$n(\theta) = \frac{\sin\theta}{\sin\theta'}.$$

20. The man-made composite material antenna of claim 12, wherein the man-made composite material comprises at least one man-made composite material sheet layer, each of which comprises a sheet-like substrate and a plurality of man-made microstructures attached on the substrate, and each of the man-made microstructures is a 2D or 3D structure having a geometric pattern, and is of a cross shape or a snowflake shape.

* * * * *